US005211243A

United States Patent [19]

Strattan et al.

[11] Patent Number: 5,211,243

[45] Date of Patent: May 18, 1993

[54] ANNULUS SAFETY VALVE

[75] Inventors: Scott C. Strattan; Thomas M. Deaton, both of Tulsa, Okla.

[73] Assignee: Baker Hughes Incorporated, Houston, Tex.

[21] Appl. No.: 750,523

[22] Filed: Aug. 27, 1991

Related U.S. Application Data

[63] Continuation-in-part of Ser. No. 573,528, Aug. 27, 1990.

[51] Int. Cl.[5] ..... E21B 34/10

[52] U.S. Cl. ..... 166/374; 166/129; 166/324

[58] Field of Search ..... 166/129, 183, 319, 321, 166/324, 332, 373, 374, 375, 376, 386, 387

[56] References Cited

U.S. PATENT DOCUMENTS

| | | | |
|---|---|---|---|
| 3,186,483 | 6/1965 | Schwab | 166/42 |
| 4,018,276 | 4/1977 | Bode | 166/183 |
| 4,049,052 | 9/1977 | Arendt | 166/183 |
| 4,460,040 | 7/1984 | Bowyer | 166/129 |
| 4,576,235 | 3/1986 | Slaughter et al. | 166/374 |
| 4,589,482 | 5/1986 | Bayh, III | 166/105.5 |
| 4,869,318 | 9/1989 | Kellett | 166/87 |

*Primary Examiner*—William P. Neuder

*Attorney, Agent, or Firm*—Melvin A. Hunn; Mark D. Perdue

[57] ABSTRACT

The present invention relates to a subterranean well annulus pressure safety valve. In one embodiment, the valve is full opening to permit complete access therethrough of wireline and other remedial tools, and contains the annulus safety valve members completely offset from the central housing. The invention also relate to an annulus safety valve wherein a series of valve elements are placed exterior of a central housing and may be staged to open in series upon incremental increase of pressure thereacross. The annulus safety valve also provides pressure equalization means to equalize pressure across the valve cluster prior to opening of the cluster. The annulus safety valve also has selectively disengagable sealing plug means therein which may be removed while the valve is in the well to increase total fluid flow area through the valve components of the apparatus. A method of controlling an annular area interior of casing within a well using the annulus safety valve also is disclosed.

32 Claims, 13 Drawing Sheets

ANNULUS SAFETY VALVE

CROSS-REFERENCE TO RELATED APPLICATION

This application is a continuation-in-part of the earlier application Ser. No. 07/573,528, filed Aug. 27, 1990, entitled "Annulus Safety Valve".

BACKGROUND OF THE INVENTION

1. Field of the Invention

The invention relates to an annulus safety valve for use in a subterranean oil and/or gas well and to a method of controlling pressure within an annular area using the safety valve.

2. Description of the Prior Art

Subsequent to the drilling of a subterranean oil and/or gas well, it is completed for the production of fluid hydrocarbons therein by introducing into the well, on a production or workstring, a well packer through which is secured the production or workstring extending to the top of the well. The well packer will be sealingly engaged with the interior of the casing in the well and somewhat above a production zone through which the produced hydrocarbons initially flow interior of the casing, thence through the interior of the packer and production or workstring to the top of the well. Sometimes the packer is included as an integral component of a more complex tool, such as a tubing hanger or the like. Such tools may be run and set in the well together with other tools on the production or workstring in one trip of tubing within the well, or may be run and set separately.

It often occurs in a well that a plurality of zones are intended to be produced either concurrently or selectively. It also occurs that the well "annulus", which in the well is the space between the inner diameter of the well casing to the exterior diameter of the production and/or workstring, is utilized to either produce fluid hydrocarbons from another production zone either above or below the first zone, as described above, or for purposes of injecting treatment fluids from the top of the well to a particular zone.

Just as safety valves must be provided to selectively sealingly block the interior of the production or workstring so that flow of fluid hydrocarbons from the production zone to the top of the well may be shut off at such safety valve to prevent a "blow out" in the event of an uncontrollable situation, such as fire, or the like, so the well "annulus" must likewise be controlled if it is exposed to a second production zone or is to be used for injection of fluid for one reason or another from the top of the well to a given production zone within the well.

While annulus safety valves have been utilized in the art, none are "full opening", so the internal diameter of such safety valve components for the annulus is not substantially equal to the internal diameter of the production or workstring, such that tools carried on remedial coiled tubing, wire or electric line, may safely and completely pass therethrough without any interference to longitudinal and/or rotational movement.

As set forth above, the purpose of such annulus safety valves herebefore utilized has been to control well pressure below such valves from communicating the tubing/casing annulus across such valves. It would be desirable to provide control of the annulus, yet permit selective injection of chemical inhibitor, kill fluid, and the like within the annular area between the tubing and casing from above the annulus safety valve to the area therebelow and within the interior of the casing on a selective volumetric basis.

Furthermore, it would be desirable to permit increased fluid flow across such annulus safety valve, selectively, merely by increase of fluid pressure within the tubing casing annulus above the annulus safety valve by permitting plug means which may be shearingly removed from sealing engagement within the valve to permit increase in fluid flow therethrough, such plug means also being replaceable by additional valve head and seat members of the same design and operation as other valve head and seat members forming the annulus safety valve.

The present invention addresses the above-identified problems and provides a unique annulus safety valve as described below and in the drawings incorporated herein.

SUMMARY OF THE INVENTION

The present invention provides a subterranean well annulus safety valve for control of fluid flow between outer and inner tubular conduits concentrically disposed within the well, said conduits extending from a first end of the safety valve to a point in the well.

The annulus safety valve comprises a cylindrical central housing securable to the inner of said tubular conduits. A fluid flow passageway is defined through the central housing and is in fluid flow communication with the interior of the inner of the tubular conduits.

In a preferred embodiment, the internal diameter of the inner tubular conduit and the internal diameter of the central housing are substantially equal.

A ported second housing circumferentially extends around the exterior of and is carried by the central housing, with the second housing being in fluid flow communication at one end thereof with fluid between the outer and inner tubular conduits within the well.

Control valve means include valve head seat members which are disposed in the second housing with the head and seat members being in normally closed position to prevent fluid between the outer and inner tubular conduits from flowing through the central valve means, with the head and seat members being movable relative to one another to permit fluid flow through the control valve means.

The apparatus also includes, in one embodiment, a ported housing with a series of ports defined therethrough and circumferentially extending around the housing and at least one of the ports receiving the valve head and seat means.

In the preferred embodiment, the valve seat is on the housing and the valve head is selectively sealingly engagable therewith.

The apparatus also includes pressure equalizing means within the ported second housing which is selectively movable while the valve head and seat means are in closed position from a first closed and sealed position to a second open pressure equalizing position to thereby equalize pressure across the valve head and seat means and the exterior of the central housing.

In the preferred embodiment, there is provided a series of valve head and seat members, with the valve head and seat members including members thereon to initiate movement of each of the valve head and seat members in sequence from a normally closed position to permit fluid flow therethrough in response, preferably, to varied application of pressure thereacross as well as when well pressure upstream of the members is greater than pressure downstream of such members.

As used herein, both in the claims and in the specification, the term "normally closed" means the position at which the valve head and seat members are located when there is no pressure differential thereacross.

DETAILED DESCRIPTION OF THE INVENTION

Figure 1:
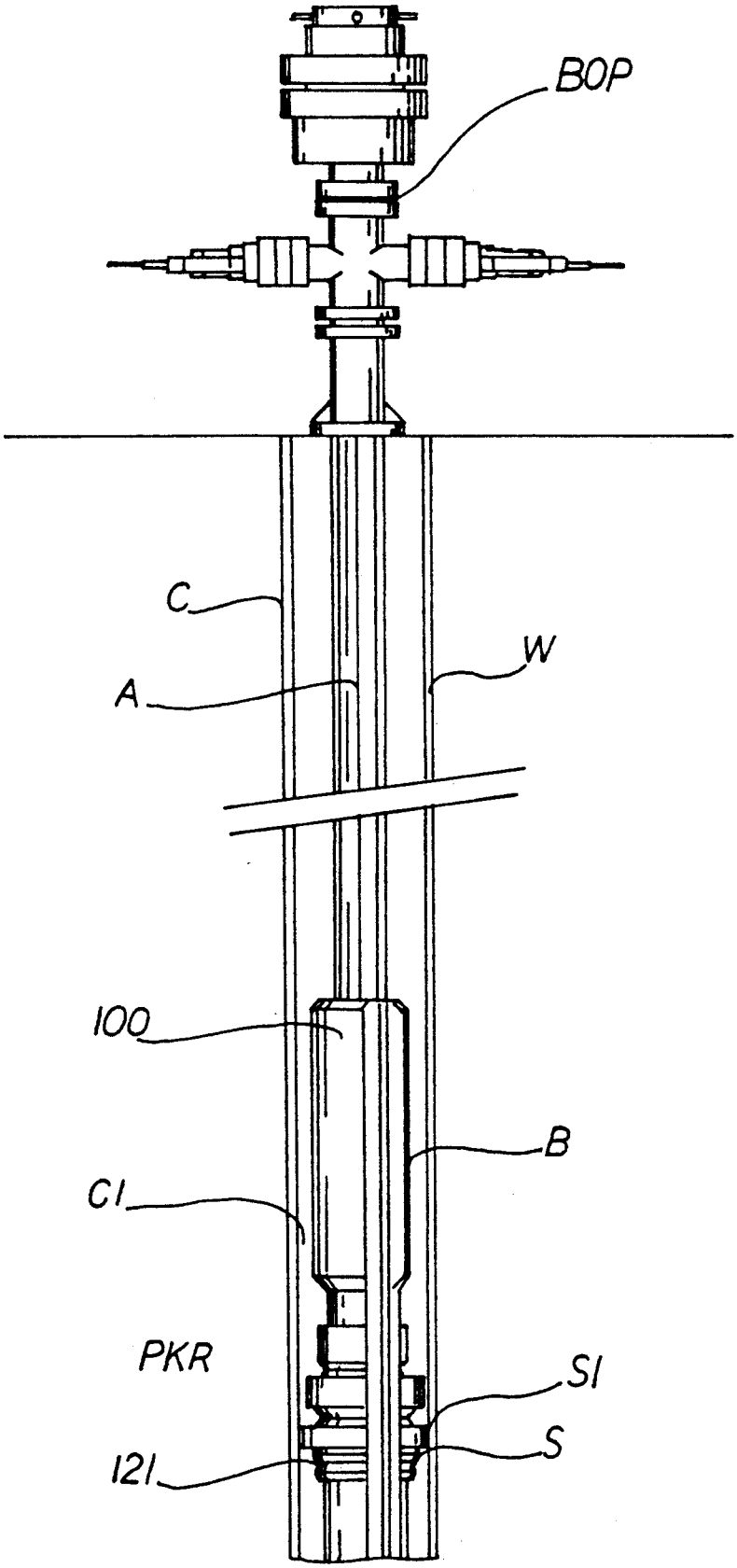
FIG. 1 is a longitudinal section schematic illustration of a well incorporating the annulus safety valve system of the present invention, in schematic view.
Figure 2:
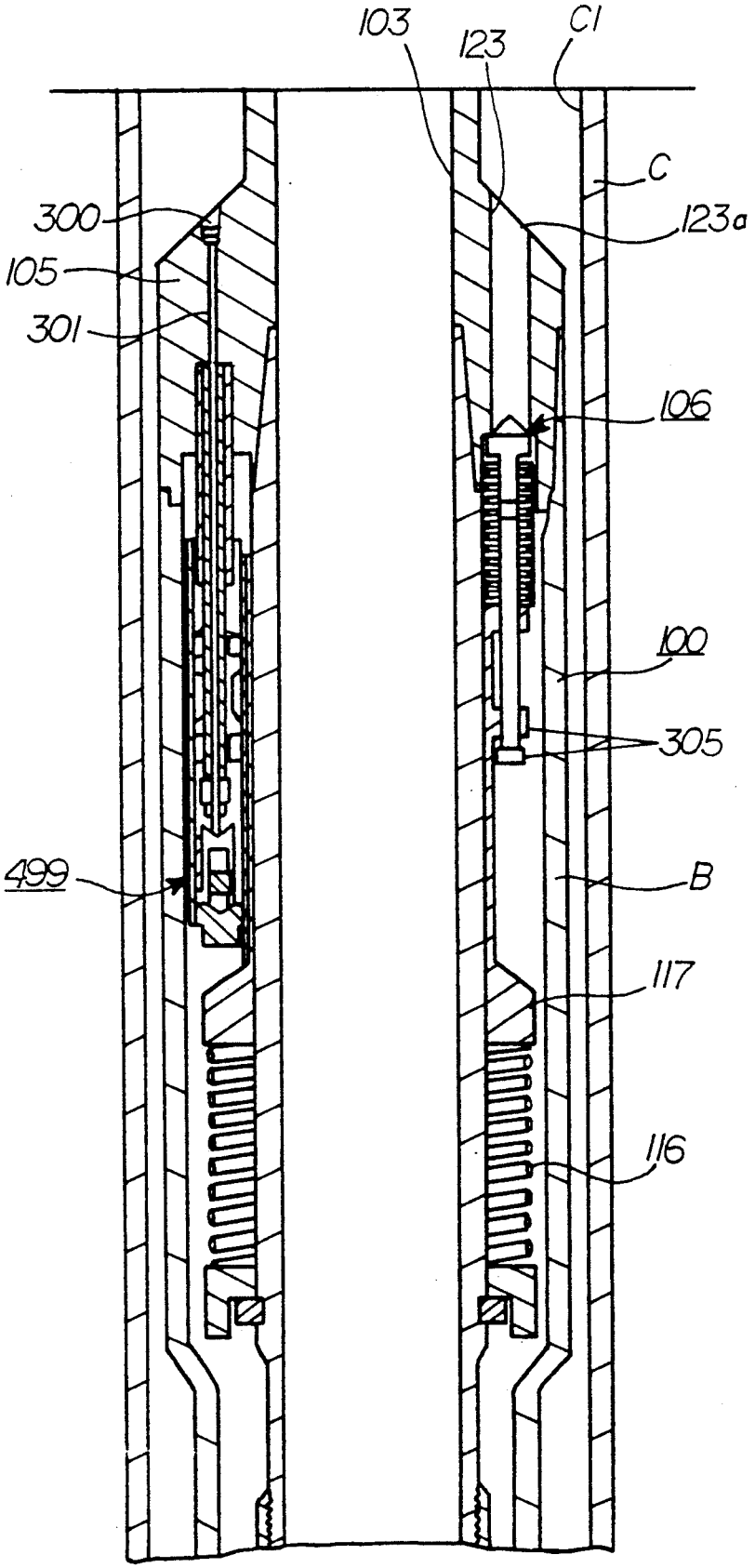
FIG. 2 is a longitudinally extending half sectional illustration of the annulus safety valve of the present invention in normally closed position.

Now with reference first to FIG. 1, there is schematically shown a subterranean oil or gas well W which has affixed at the uppermost end thereof a conventional preventor stack BOP.

The well W is encased with a string of casing C with a packer PKR in gripping and sealing engagement with the internal diameter C1 of the casing C by means of slips S and elastomeric seal S-1. The packer PKR is carried into the well on an inner tubular conduit A which is secured to the packer PKR by means of threads 122. Also extending through the interior bore of the packer at end 121 is an outer conduit B, the interrelationship with other components being hereinafter described in detail.

Now, with particular reference to FIGS. 2 through 5, the apparatus 100 is shown in detail and is secured at threads 101 to the lowermost end of the inner tubular conduit A. The inner tubular conduit A has an inner diameter A1 which is substantially the same as the inner diameter 103 of an inner conduit 102 portion of the apparatus 100 which is secured by means of the threads 101 to the inner tubular conduit A.

The interior A2 of the inner conduit A is always in fluid communication with companion fluid flow passageway 104 extending through the interior of the conduit 102 of the apparatus 100.

Around the upper end of the inner conduit 102 and secured thereto by threads 101*a* and defining the lower most end of the tubular conduit A, is a circumferentially extending ported second housing 105 having a passageway 123 defined longitudinally therein with a first open entry way area 123*a* defined between the exterior of the inner tubular conduit A and the internal diameter C1 of the casing C.

The end opposite the opening 123*a* of the ported second housing 105 defines a circumferentially subscribed angularly beveled metallic valve seat 107 for companion receipt of a valve head end 108*a* of a valve head member 108. These valve head and seat members are normally biased to the closed position, but are selectively openable upon either application of pressure through the opening 123*a* into the passage 123 from the top of the well, or, more preferably and conventionally, by means of application of hydraulic or pneumatic control fluid pressure through the control fluid passageway 301 extending to a control conduit (not shown), to the top of the well, as described hereafter. The valve head 108 and the valve seat 107 members together consitute the control valve means 106.

Figure 12:
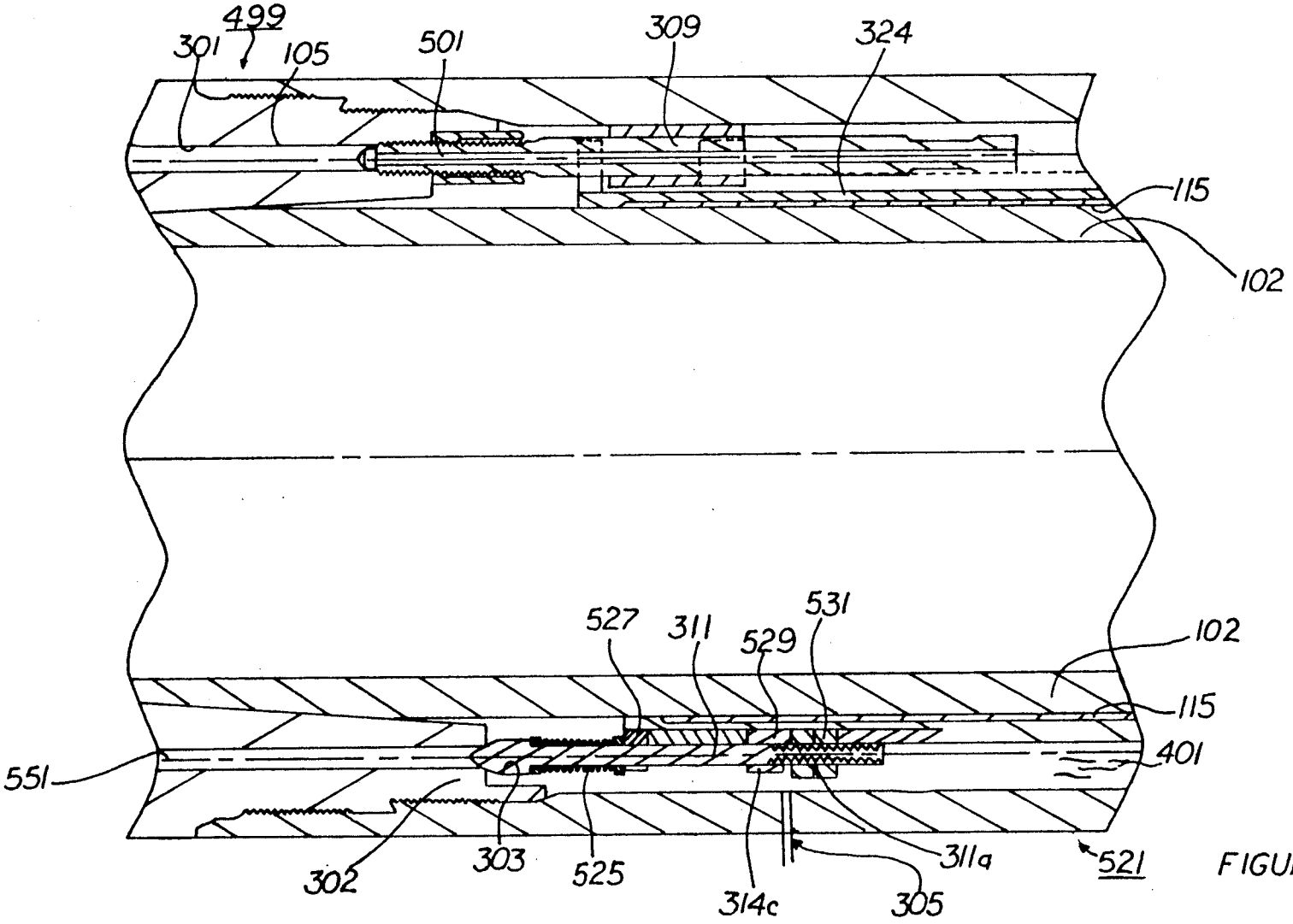
FIG. 12 is a section view as seen along line C—C of FIG. 10.
Figure 13:
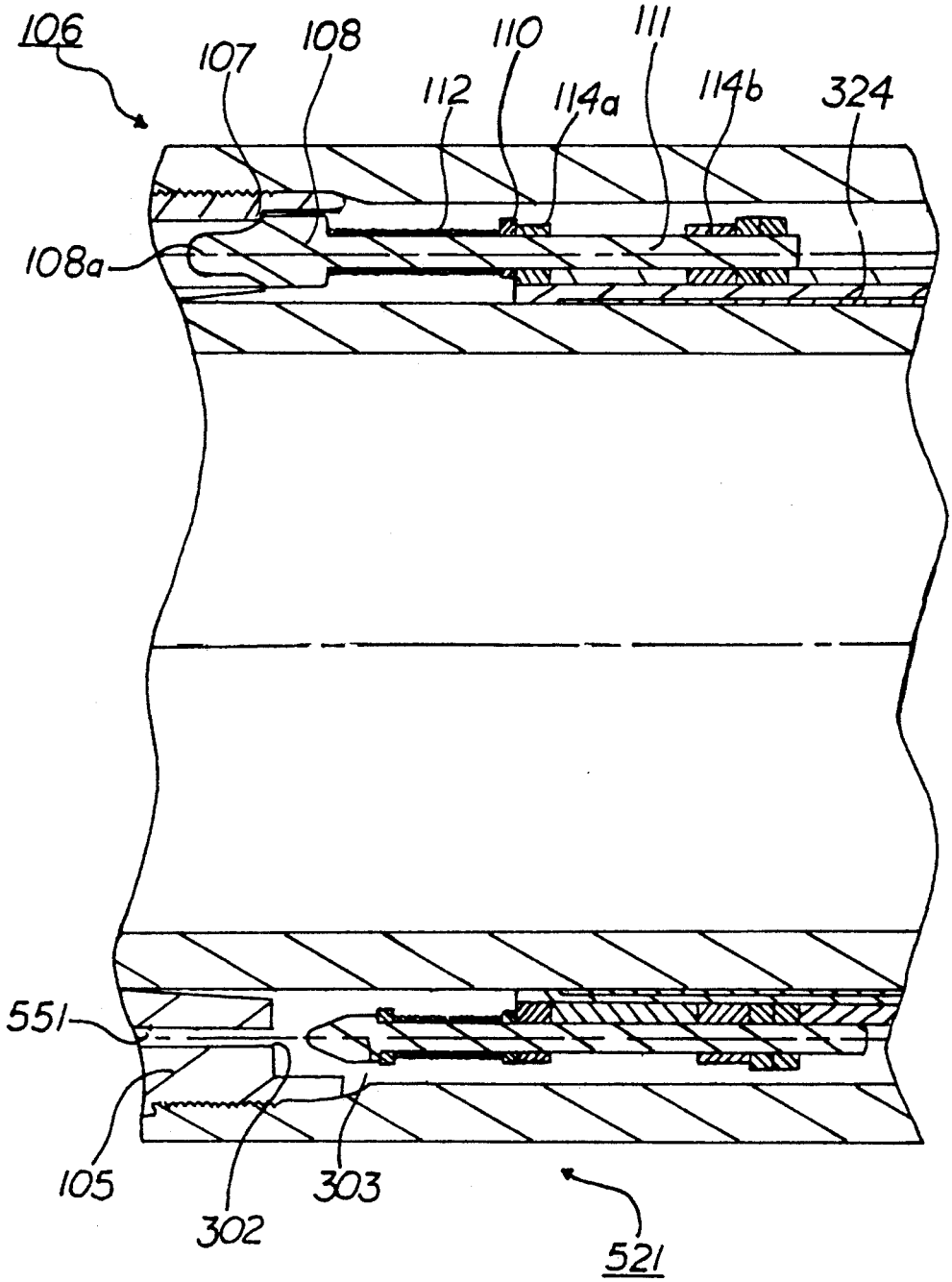
FIG. 13 is a enlarged fragmentary section view of the preferred annular safety valve of the present invention.

The valve mandrel 111 also has an enlarged lower head member 111*a* having a upwardly facing shoulder 111*a'* for selective abutting contact and engagement with a companion downwardly facing shoulder 114*c* and the shoulder 111*a'* defines the equalizing travel 305 required to equalize fluid across the apparatus 100 prior to the control mandrel 115 shifting the control valve means 106 to the open position subsequent to manipulation to the open position of the equalizing valve head 303 and the equalizing valve seat member shown in FIGS. 12 and 13.

In the preferred embodiment, there are a series of passageways 123 with openings 123*a* circumferentially defined through the ported second housing 105 with a plurality of control valve means 106 disposed therethrough. Approximately 180° from the first control valve means 106 is the equalizing valve means, including the equalizing valve seat member 302 and its equalizing valve head 303, as further described hereafter.

Figure 11A:
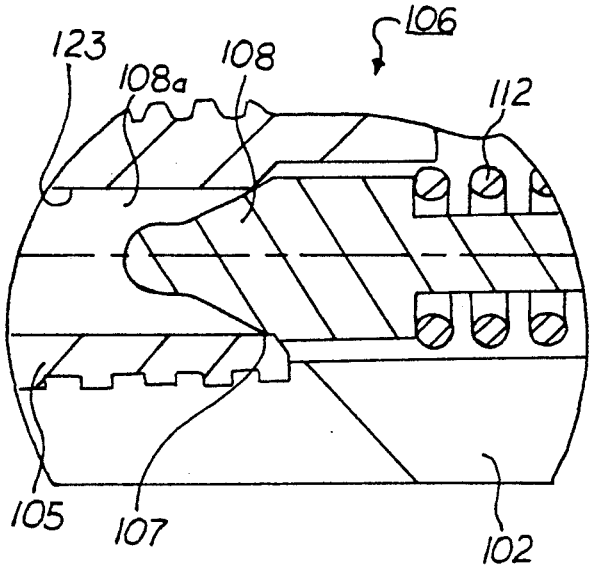
FIG. 11*a* is an enlarged view of region "C" of FIG. 3, and depicts valve head member 108 and valve seat 107.
Figure 11B:
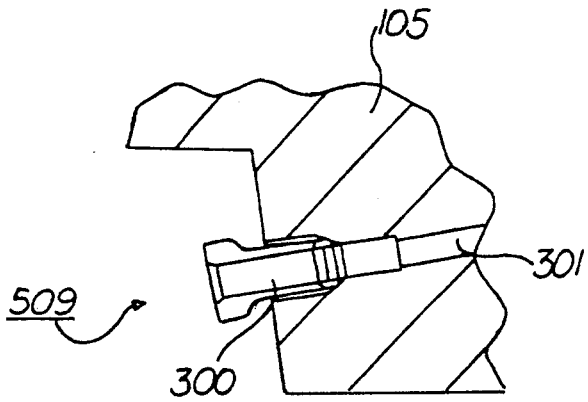
FIG. 11*b* is an enlarged view of the detail "D" of FIG. 2, and depicts the passageway 301 and connector 300, which receives a high pressure hose such as a control line which directs high pressure fluid through passage 301.
Figure 11C:
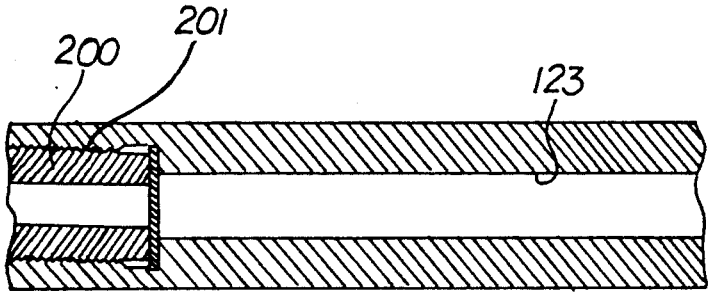
FIG. 11*c* depicts a passage 123, which is plugged with plug element 200.

As shown in FIG. 11*c*, one or more of the passageways 123 may contain a plug element 200 which is secured to the ported second housing 105 by means of threads 201, shear pin, or the like, thus the plug means 200 replacing one or more of the control valve means 106.

Returning now to FIGS. 2 through 5, the control mandrel 115 has its upper end an enlarged top spring seat 117 which receives the uppermost end of a power spring 116. The power spring 116 is housed radially around the exterior of the inner conduit 102 and has its lowermost end arrestingly secured on the upper face of a bottom spring seat 118 secured to the inner conduit 102 by means of a beveled shoulder 102*a*. Control mandrel 115 also extends radially around the exterior of inner conduit 102.

The power spring 116 is, in effect, a biasing means and may be provided in the form of Belleville washers, a collapsible spring element, or the like. At any rate, the function of the biasing or power spring element 116 is to transmit a closing force from the inner conduit 102 through the control mandrel 115 to the control valve means 106, such that the valve head 108 is in sealing engagement with its companion valve seat 107 and the valve head end 108*a* extends, slightly, within the passageway 123. The force defined through the biasing means or power string 116 may, of course, be selectively varied, such that the control valve means 106 may be manipulated from the normally closed position to the open position to permit fluid flow through the passageway 123 at varied pressure.

Moreover, the biasing force through the power spring 116, together with the force defined through the control spring 112 may be selectively varied with respect to two or more control valve means 106, such that the various valve heads 106 within the ported second housing 105 may be serially manipulated to open position.

Alternatively, or concurrently, the size and configuration of the valve head 108 may be altered or varied, slightly, such that each of the control valve means 106 are manipulated to the open position upon various changes in fluid pressure encountered thereacross.

The annulus safety valve apparatus 100 of the present invention may be manipulated from the normally closed position, shown in the drawings, to the open position to permit fluid flow through the passageway 123 between the inner conduit 102 and the external or outer conduit B by means of application of hydraulic control pressure from the top of the well through the control conduit (not shown), which communicates into the control fluid passageway 301 and which is secured at threads 300 to the ported second housing 105.

Additionally, if it is desired to pump fluid in the tubing/casing annulus from the top of the well through the apparatus 100, thence through the packer in the annular area defined between the inner conduit 102 and the outer conduit B to the area of the well below the packer PKR, the control valve means 106 can be provided such that the bias towards the closed position defined as the power through the power spring 116 in combination with the control spring 112 can be varied such that any anticipated pressure through such annular area from the top of the well will open such control valve means 106 for injection purposes. However, it will be appreciated that by manipulating such control valve means 106 in such fashion, such control valve means 106 will not be able to be first manipulated to pressure equalizing condition and that such manipulation of the control valve means 106 should preferably be done only when pressure across the control valve means 106 is substantially equal and that there is no effective differential pressure thereacross which could adversely affect the sealing integrity of the valve members 108, 108*a*.

Referring now to FIGS. 12 and 13, for equalization purposes, an equalizing valve seat member 302 receives an equalizing valve head 303 defining the uppermost end of the valve head stem 311.

The equalizing valve head 303 is moved away from the the equalizing valve seat member 302 to equalizing position which is defined as the equalizing travel 305 between the shoulder 314*c* and the shoulder 311*a* between the valve mandrel 311 and the control mandrel 115. Until such equalizing travel 305 is completed, the control valve means 106 will not be moved from the normally closed position, thus enabling the equalizing valve members 302, 303 to be manipulated from fully closed position to fully open position prior to actuation of the control valve means 106, thus assuring that there is no differential pressure across the control valve means 106.

Now with reference to a hydraulic actuator 499 as shown in FIGS. 6–9, a sealing assembly 306, 307 provides a metal to metal seal to control fluid line. A piston collar 308 retains the seal assembly 306, 307 relative to the valve head stem 304. A piston member 309 is stationarily attached to the second ported housing 105 and locates a cylinder member 320. A metal to metal seal assembly is defined between the lowermost end 321 of the member 320 and the uppermost end 322 of cylindrical stop member 350 which, in turn, is secured at threads 323 to a cylindrical central housing member 324 which, in turn, is secured at threads to a lower closed end member 326.

The cylindrical member 324 is secured relative to the control mandrel 115 by means of cylinder stop 350 such that the cylinder 324 is the dynamic moving component and the piston 309 is the secured, static non-moving component. Thus, members 324, 350 and 326 form a cylindrical configuration.

The stop 350 has at one end thereof a metal to metal seal defined at it's lowermost end 323 and mating with the upper end 324*a* of cylinder 324 and protruding around piston 309.

A spring element 325 energizes the sealing member 325*a*, with piston bearing 326 centering the piston assembly with seals interior of the cylinder. A dynamic wiper seal 327 is provided above a support ferrule 328 with the seal 327 being nonelastomeric for sealing out control fluid. The support ferrule 328 is a metal to metal backup for the wiper seal element 327 and is functional for wiping contaminants relative to the solid cylindrical elements during stroking of the piston assembly.

A second piston bearing 329 centers the piston assembly within the cylinder.

Wedge 330 supports the lower piston bearing 329 and a lower the dynamic wiper seal 327*a* and is threadably secured to the piston housing. A locknut 331 is provided securing the sleeve 330 to the piston 309.

A plug stop seat 332 is provided which is a metal to metal seal on the bottom of the piston 309 at seat 333, with an expander shim 334 being provided for translation of the spring force in a biasing spring 335 to the plug stop seat 332. A cylinder plug end 326 closes the end of the cylinder with a metal to metal seat at point 336.

OPERATION

The apparatus 100 will be run into the well W and positioned as shown in FIG. 1. When it is desired to open the control valve means 106, the apparatus 100 is first equalized by moving the equalizing valve head 303 from the equalizing valve seat member 302. This is effected by first applying an increase of pressure within the control fluid conduit through the passageway 301 to pressurize the interior of the cylinder below the lower dynamic wiper seal 327*a* to extend the cylinder away from the ported second housing 105. The cylinder stop 350 contacts the control mandrel 115 which moves the control mandrel 115 downwardly against the power spring 116 to compress such power spring 116. Now the shoulder 314c of the control mandrel 115 will move toward the shoulder 311a the distance of travel being the equalizing travel distance 305. As the shoulders 314c and the head 311a come together, the valve head 303 is stroked away from the seat member 302, thus permitting annulus fluid 401 to be equalized with pressure below the ported second housing 105. When the equalizing travel 305 is completed by continued application of fluid pressure through the control fluid passageway 301 from the control fluid line, the power spring 116 continues to be further compressed and one or more of the control valve means 106 are manipulated to open position with the valve head 108 being moved from the valve seat 107, respectively, depending upon the additional power defined through the control spring 112. Likewise, the control valve means 106 are manipulated to closed position by reduction in control fluid pressure through the control fluid conduit and the control fluid passageway 301, and the valve head means 106 are manipulated to closed position as the power in the spring 116 overcomes the fluid pressure in the control fluid passageway 301.

DETAILED STRUCTURE

Figure 3:
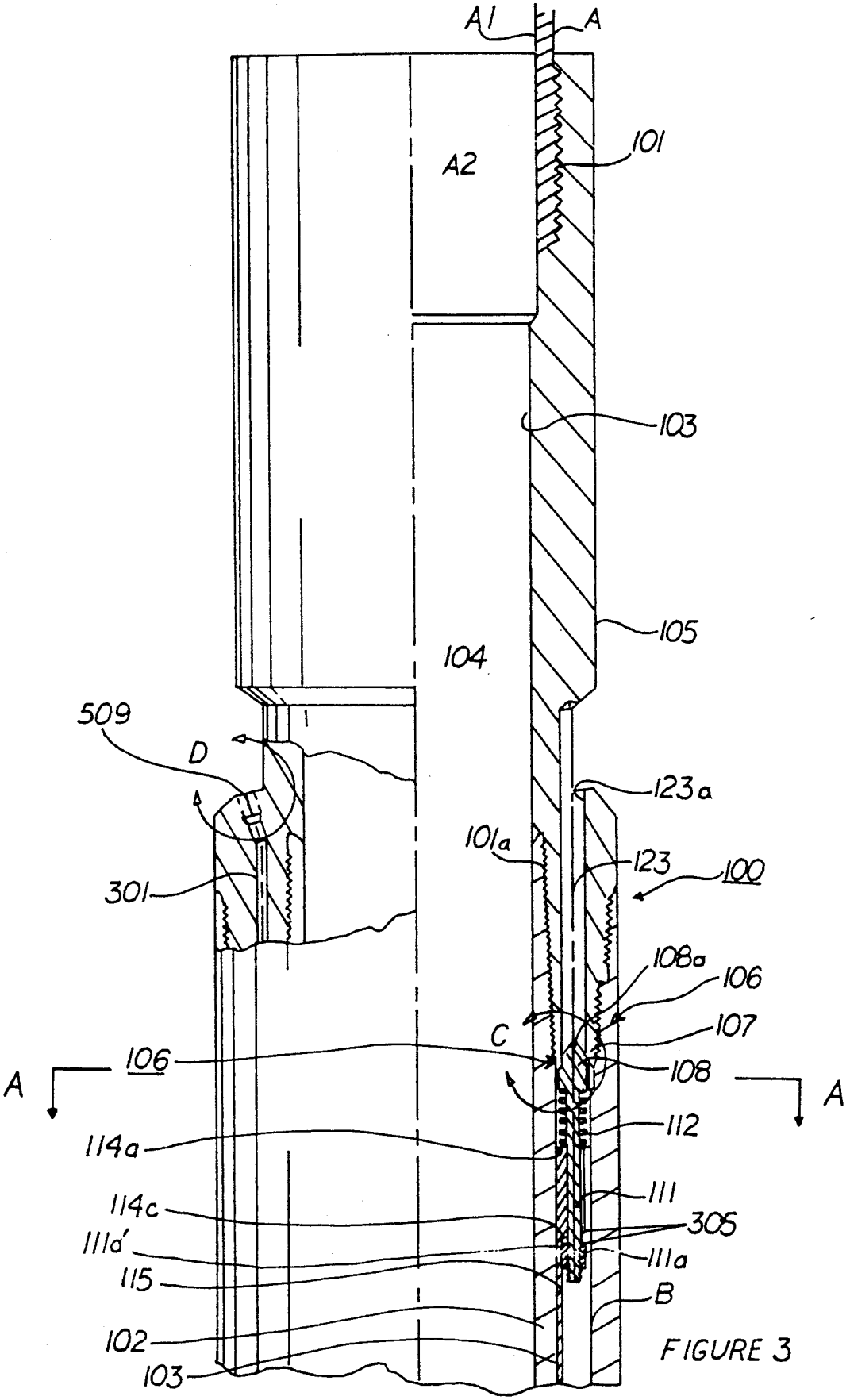
FIGS. 3, 4, and 5 together are a more detailed view of the valve of FIG. 2, in one-quarter longitudinal section view, with FIG. 3 representing the uppermost portion of the valve, FIG. 4 representing the middle portion of the valve, and FIG. 5 representing the lowermost portion of the valve.

FIG. 3 is a view of the upper portion of annular safety valve 100 of the present invention in one-quarter longitudinal section view. Annular safety valve 100 includes ported second housing 105 which mates at threads 101 with production tubing A. The preferred annular safety valve 100 of the present invention includes two paths for receiving fluid. The first is a connector 509 which is adapted for coupling to a high pressure fluid hose which provides a control fluid to annular safety valve 100 of the present invention. Fluid directed from the control line of the high pressure hose is directed inward into annular safety valve 100 via fluid passage 301. The second opening is passageway 123, which will allow wellbore fluid in the annular region between tubing string 101 and casing C to pass through when valve 106 is in open condition.

FIGS. 11a and 11b show connector 509 and valve 106 in enlarged view. As shown in FIG. 11a, valve 106 includes valve head 108 which releasably engages valve seat 107. As shown, valve seat 107 is merely a circular passageway which is adapted in size and shape to sealingly engage a tapered portion of valve head 108. In the preferred embodiment of the present invention, valve head 108 and valve seat 107 are maintained in a normally-closed position, and cooperate in preventing the passage of fluid into annular safety valve 103, until a predetermined amount of pressure is applied by a high pressure hose to control port 301. As shown in FIG. 11b the uppermost extent of control port 301 is threaded or otherwise adapted to receive a control hose fitting 300. In the preferred embodiment of the present invention, other fluid passageways 123 and valve assemblies 106 are provided circumferentially around annular safety valve 100. Fluid passageways 123 which are not equipped with valve assemblies 106 may be plugged, as shown in FIG. 11c.

Figure 10:
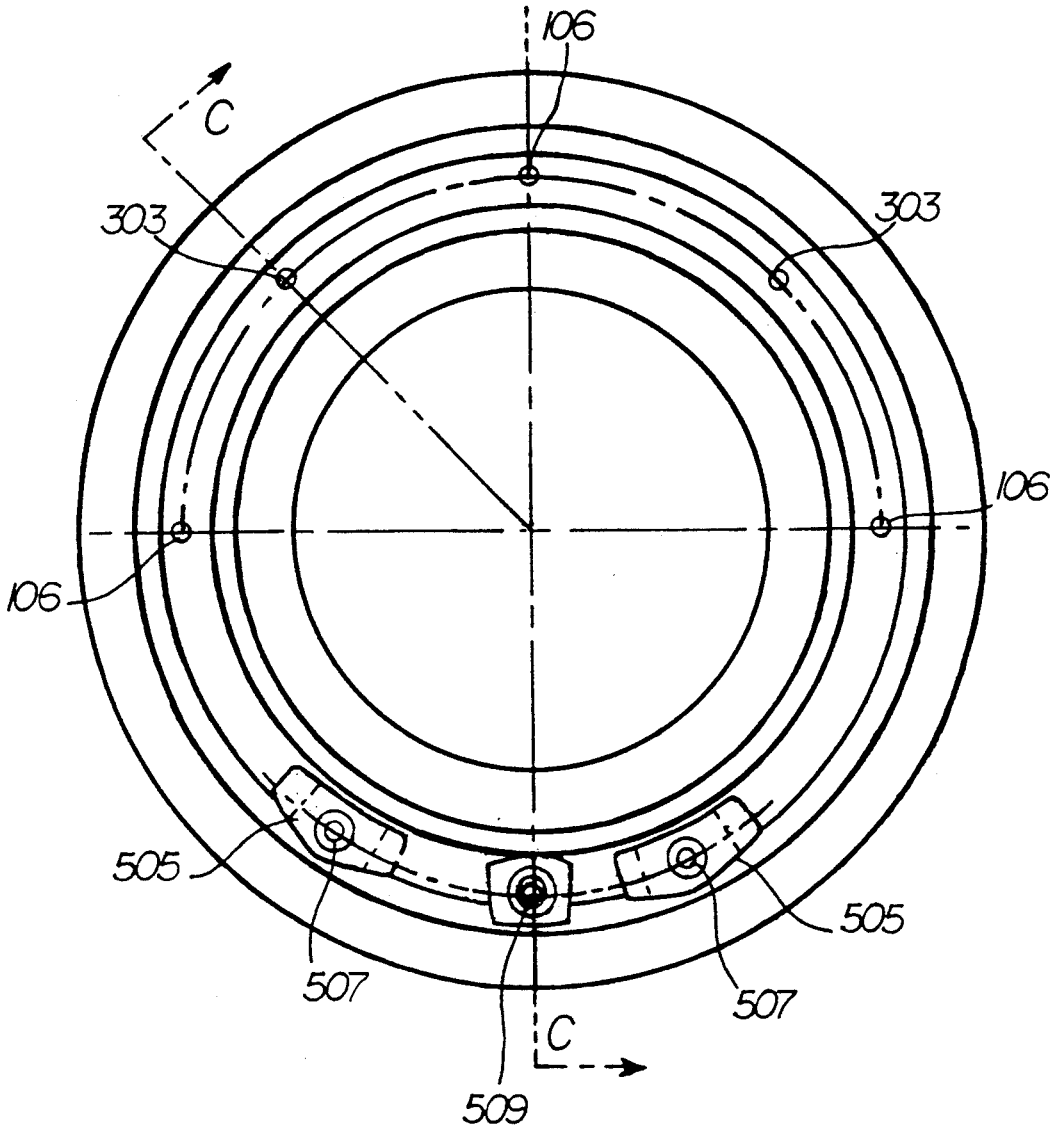
FIG. 10 is a full cross-section view of the preferred annular safety valve of the present invention, as seen along A—A of FIG. 3.

FIG. 10 is a cross-section view of annular safety valve 100 of the present invention in full cross-section view, as seen along lines A—A of FIG. 3. As shown, a plurality of valve assemblies 106 are provided, preferably three, each positioned 90 degrees apart. Also shown in FIG. 10 are fluoroplastic bearings 505 which receive guide members 507.

Returning now to FIG. 3, as shown, valve head 108 is biased upward relative to control mandrel 115 by spring 112, into normally-closed sealing engagement with valve seat 107. As shown, valve seat 107 is merely the end portion of ported second housing 105, which is equipped with a cylindrical fluid passage 123, and which is adapted in size and configuration to sealingly engage valve head 108a of valve member 108, when it is biased upward by spring 112. Valve head 108a is integrally formed with valve mandrel 111. Valve mandrel extends through the central region of spring 112, and is adapted to slidably engage a stationary piece 111a.

In the preferred embodiment of the present invention, high pressure fluid is directed from a high pressure fluid hose through fluid passage 301. The high pressure fluid operates to move a hydraulic actuator 499 between a normally-closed position and an open position, which serves to equalize the fluid pressure differential across annulus safety valve 100. In the preferred embodiment, as hydraulic actuator 499 is moved between a normally-closed position and an open position, control mandrel 115 (which extends circumferentially around inner conduit 102) is urged downward relative to inner conduit 102, causing valve assembly 106 to be moved from a normally-closed position and an open position, allowing annulus fluid to flow through the annulus safety valve 100.

Figure 6:
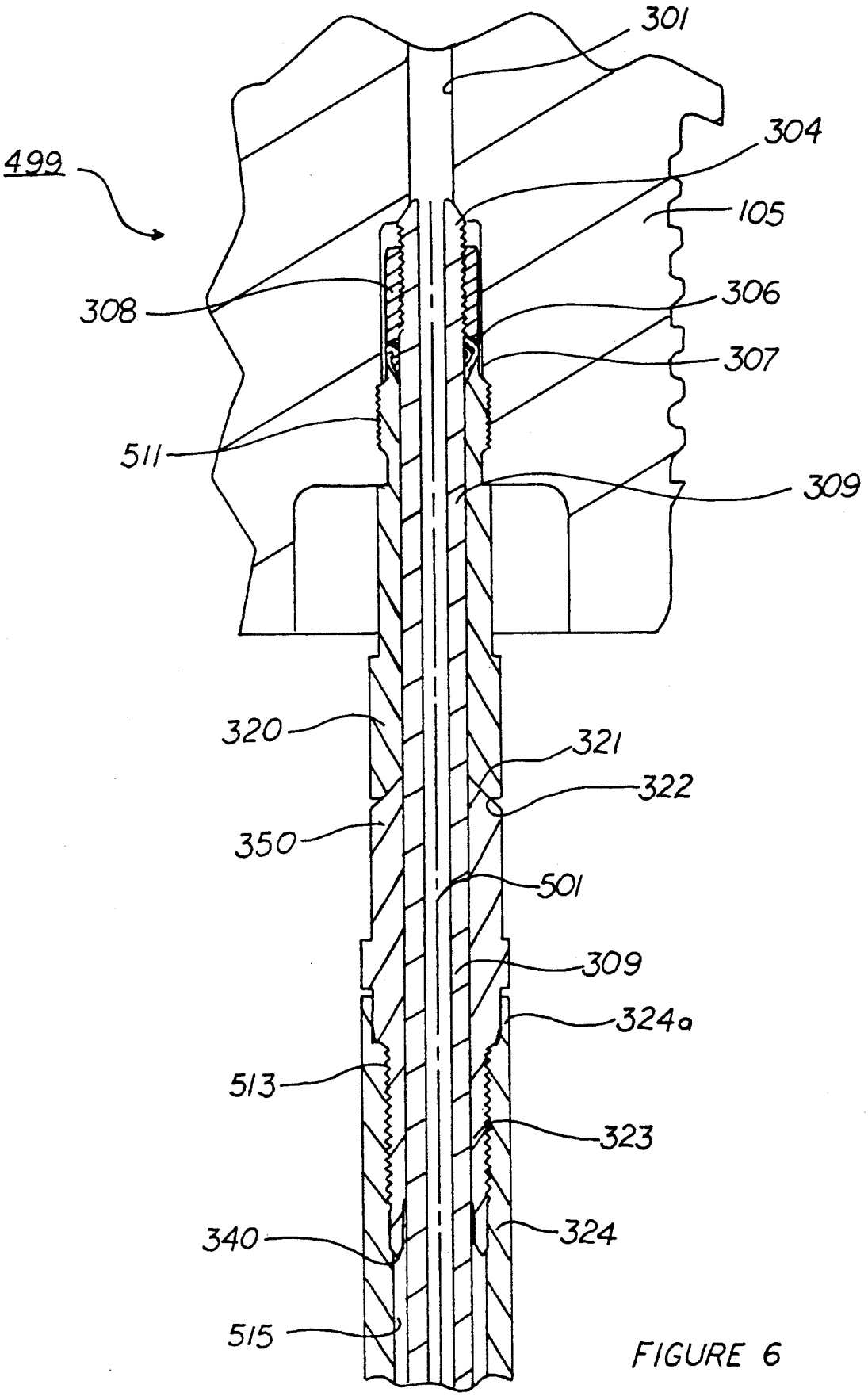
FIG. 6 is a fragmentary full longitudinal section view of hydraulic actuator 499 of the present invention.
Figure 7:
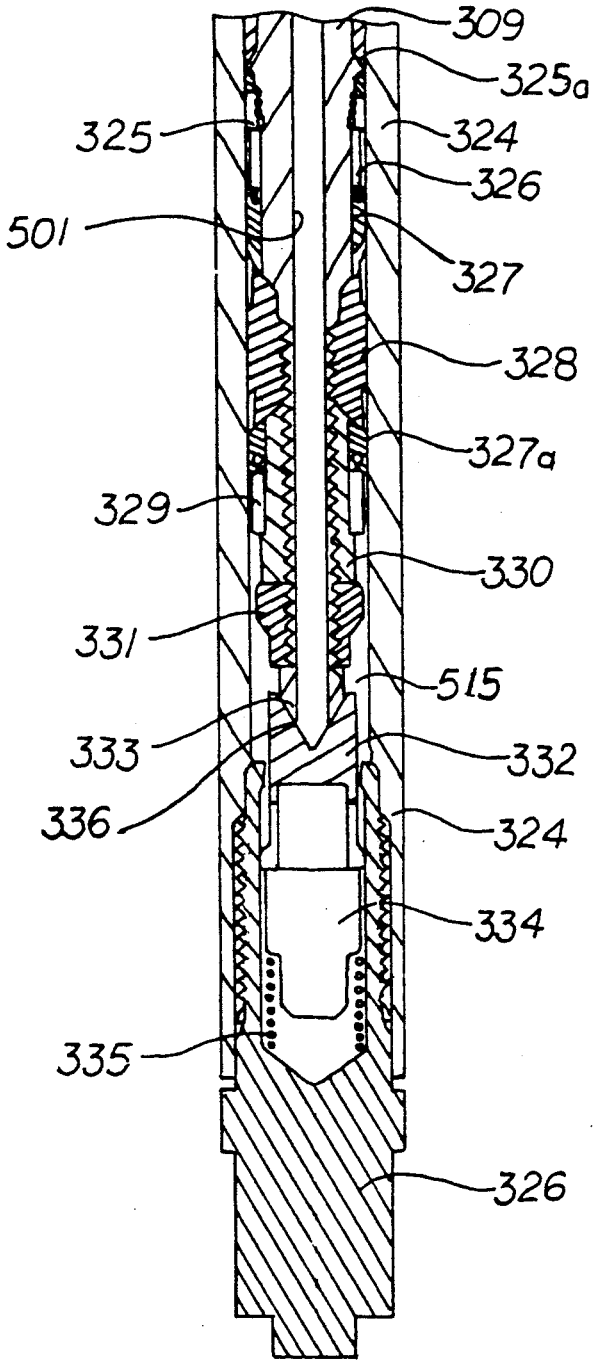
FIG. 7 a full longitudinal section view of the lower end of hydraulic actuator 499, and may be read in conjunction with FIG. 6.
Figure 8:
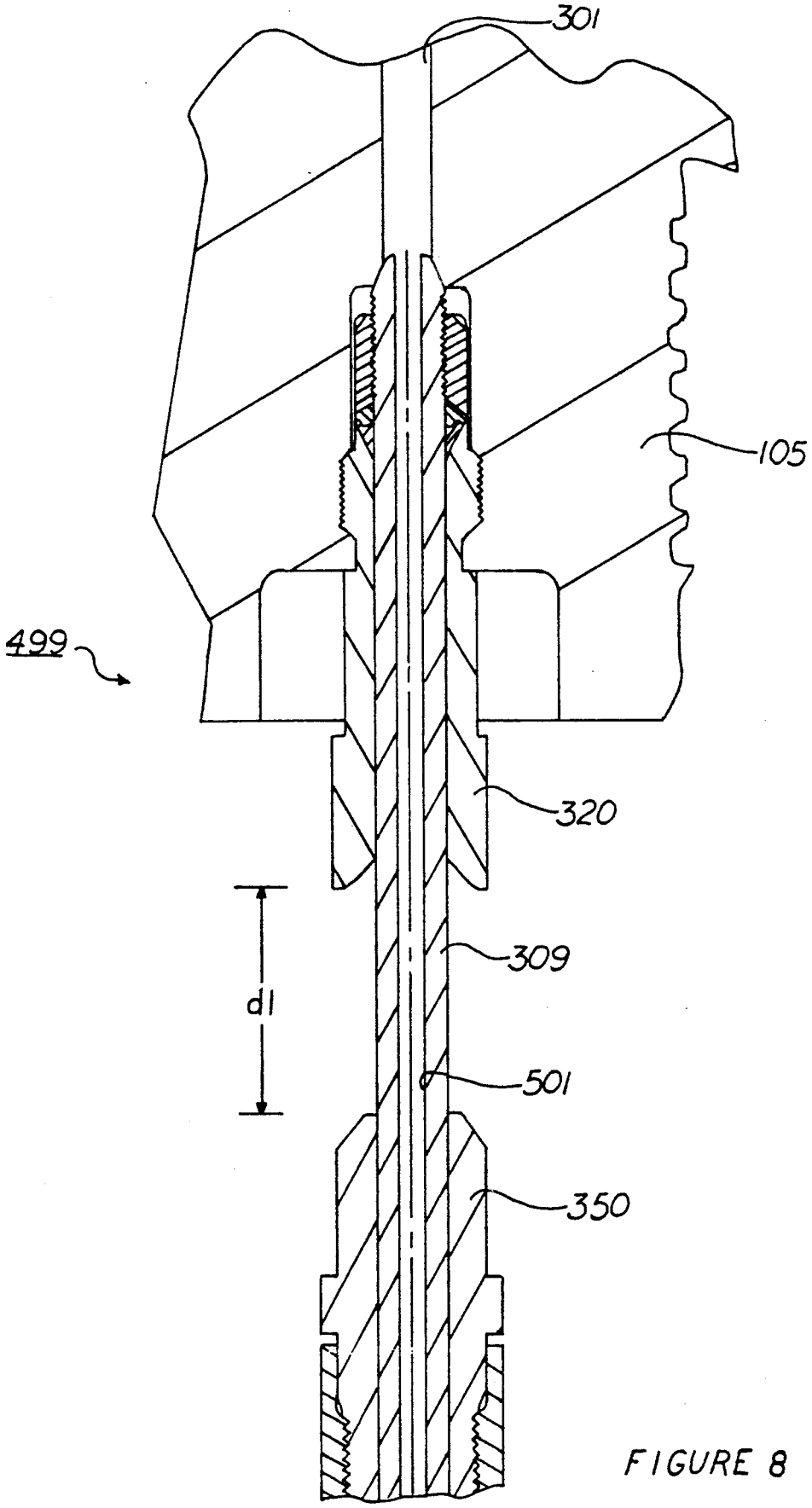
FIG. 8 is a fragmentary, and full longitudinal section view of the upper portion of hydraulic actuator 499 of the present invention.
Figure 9:
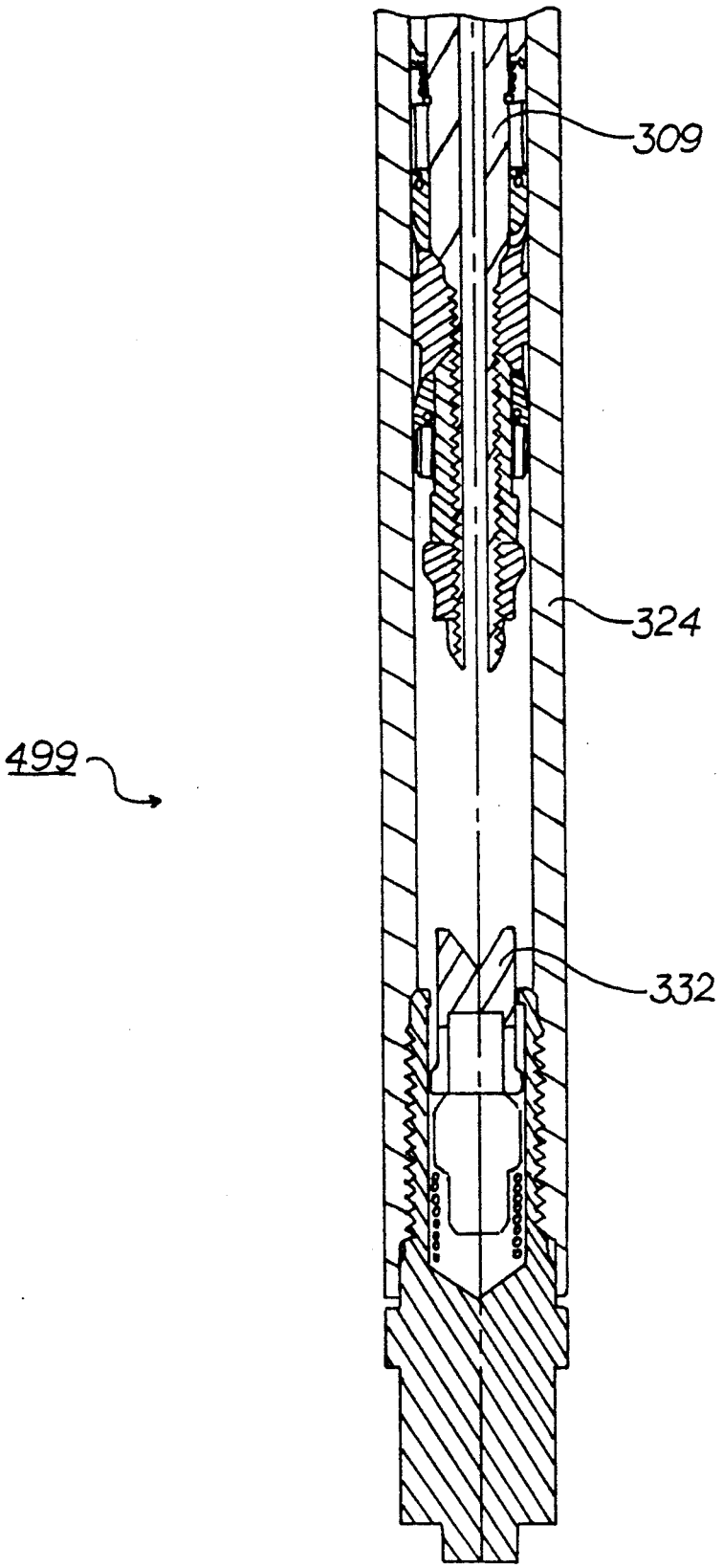
FIG. 9 is a fragmentary and full longitudinal section view of the hydraulic actuator 499 of the present invention, and may be read in combination with FIG. 8.

The operation of hydraulic actuator 499 is graphically disclosed in FIGS. 6, 7, 8, and 9. FIGS. 6 and 7 together depict hydraulic actuator 499 in its normally-closed position. FIGS. 8 and 9 together depict hydraulic actuator 499 in an open position. The relative positions of hydraulic actuator 499 and valve assembly 106 is graphically disclosed in FIG. 12.

Figure 4:
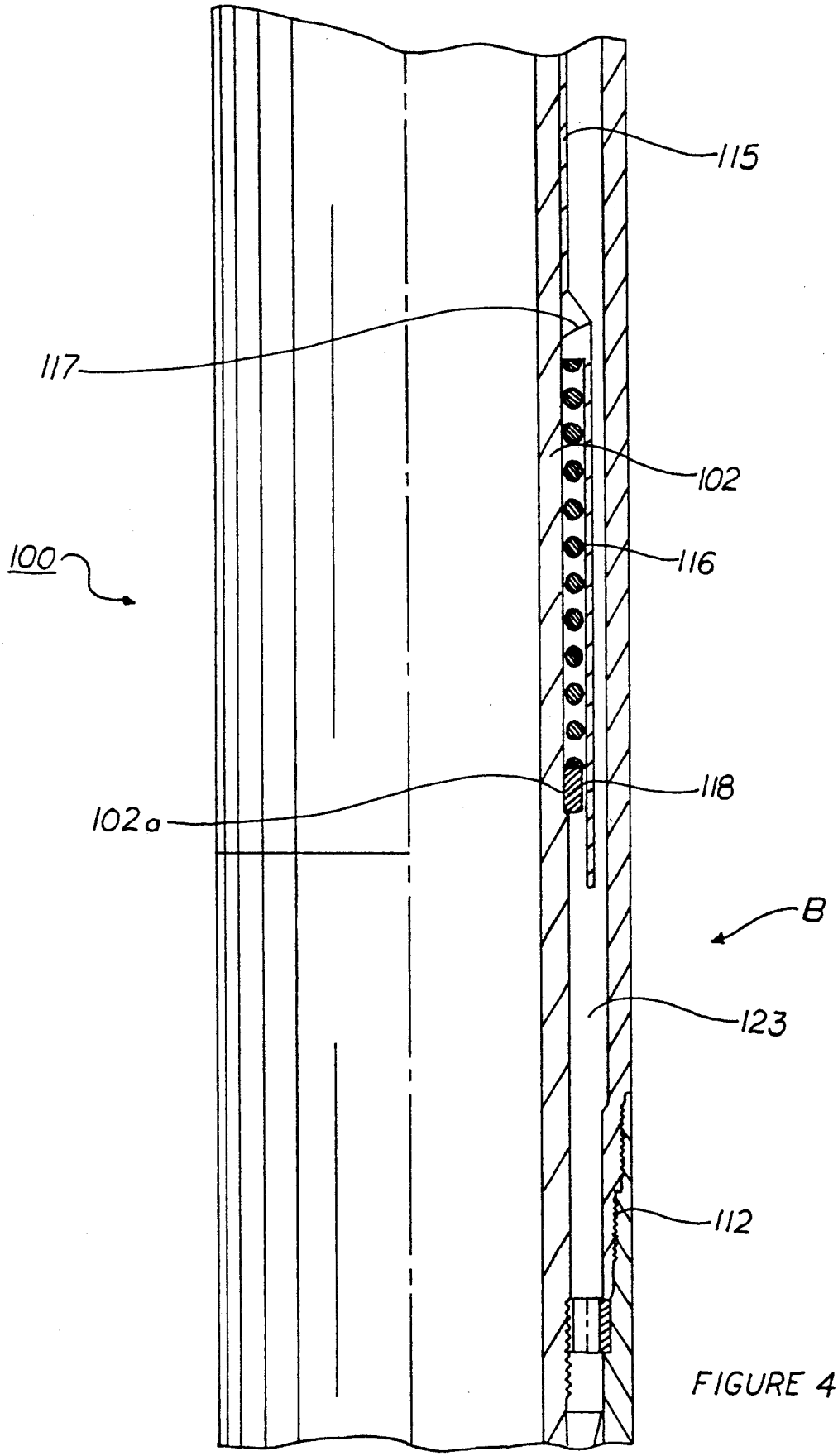

As shown in FIG. 4, movement of central mandrel 115 downward relative to inner conduit 102 causes compression of power spring 116. Therefore, as soon as high pressure fluid of a sufficient amplitude is no longer provided to fluid passage 301 to actuate hydraulic actuator 499, power spring 116 will urge control mandrel 115 upward relative to inner conduit 102, causing valve head 108a to engage valve seat 107, thus preventing the passage of fluid between annular safety valve 100 and fluid passageway 123.

Figure 5:
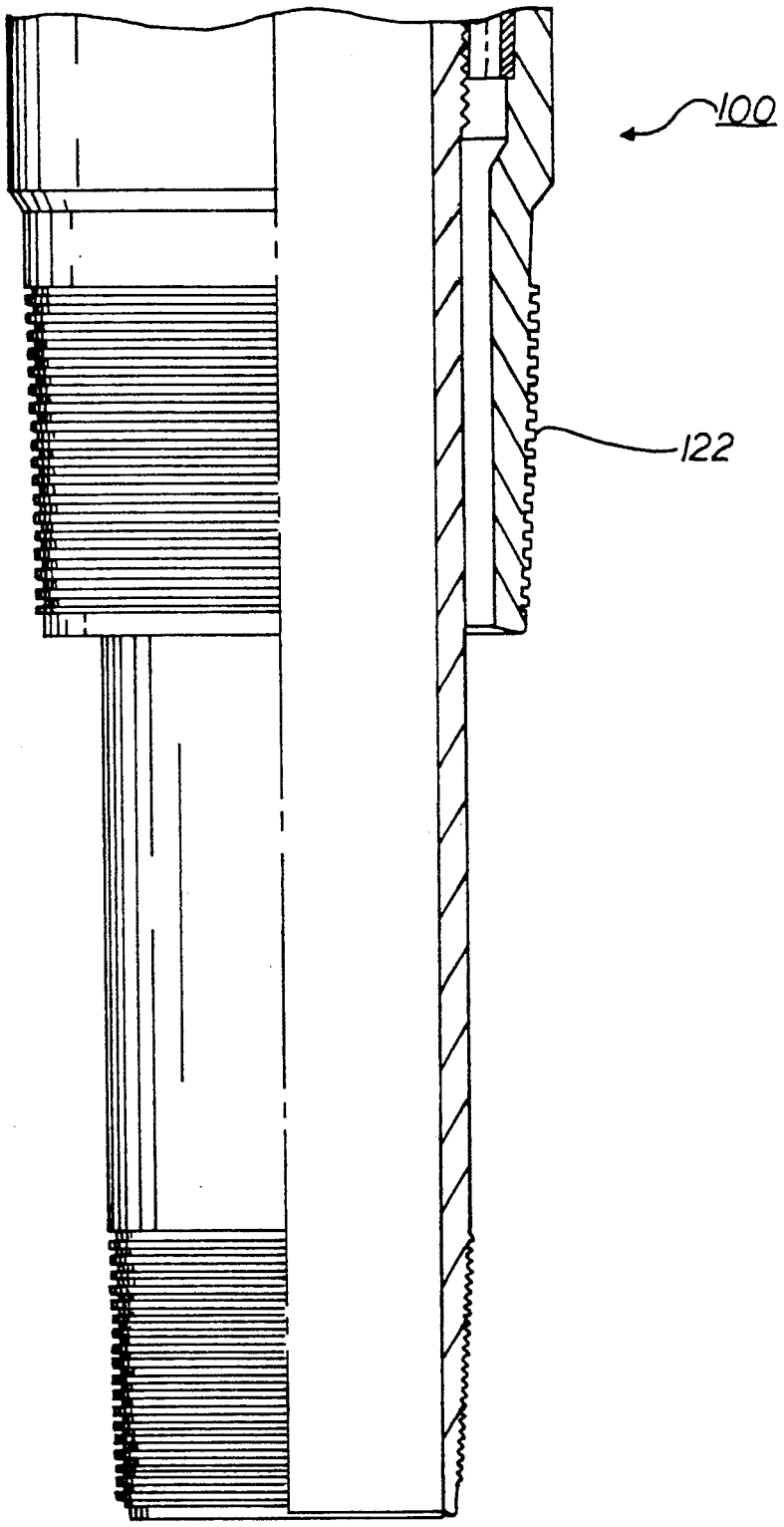

FIG. 5 shows the lower end of annulus safety valve 100 of the present invention. As shown, annulus safety valve 100 is provided with external threads 122, which releasably engage a conventional wellbore packer assembly.

The operation of the hydraulic actuator 499 will now be discussed with reference to FIGS. 6, 7, 8, and 9. As discussed above, FIGS. 6 and 7 should be read together, and graphically depict the upper and lower sections of hydraulic actuator 499, in its normally-closed operating condition. FIGS. 8 and 9 should be read together, and depict hydraulic actuator 499 in an open condition. With reference first to FIGS. 6 and 7, high pressure fluid from a control line is provided through fluid passage 301. The fluid is directed downward within piston fluid channel 501 which extends longitudinally through piston 309. In the preferred embodiment of the present invention, piston 309 is stationary, and fluid directed downward through piston fluid channel 501 operates to move cylinder 324 downward relative to piston 309, a preselected distance d1.

As shown in FIG. 6, piston lock nut 320 is secured in position relative to ported second housing 105 by threads 511. At its uppermost end, piston 309 includes piston stem 304, which is circumferentially engaged by piston collar 308 and seal assembly 306, 307. Piston lock nut 320 is provided exteriorly of piston 309. Piston lock nut 320 is in abutting relationship with cylindrical stop 350. Cylinder stop 350 and cylinder 324 are coupled together at threads 513. Annular region 515 is provided between stationary piston 309 and movable cylinder 324.

The discussion and exposition of hydraulic actuator 499 will continue with reference to FIG. 7. As shown, a number of components are provided in annular space 515 between stationary piston 309 and movable cylinder 324. These components include seal 325*a*, spring 325, and bearing 326. In addition, wiper seal 327 is provided in annular space 515 between stationary piston 309 and movable cylinder 324. Also provided in annular space 515 are support ferrule 328, lower wiper seal 327*a*, bearing 329, and wedge 330. All of the above components in annular space 515 are held in position by lock nut 331. These components do not interfere with the movement of piston 309 relative to movable cylinder 324.

At its lowermost end, stationary piston 309 terminates at seat 333, which engages plug stop seat 332, in a normally-closed mode of operation. The components disposed in annular space 515 between stationary piston 309 and movable cylinder 324 do not interfere with the movement of movable cylinder 324 relative to stationary piston 309. As high pressure fluid is directed downward within piston fluid channel 501 of stationary piston 309, force is exerted against plug stop seat 332.

Plug stop seat 332 is coupled to cylinder plug 326, and engages expander shim 334 at its lowermost end. Expander shim 334 engages spring 335. As fluid pressure is applied to the seat 333 of plug stop seat 332, plug stop seat 332 is urged downward relative to stationary piston 309, and causes expander shim 334 to compress spring 335. As seat 333 is brought out of contact with the lowermost end of stationary piston 309, fluid is allowed to enter the annular space 305 between cylinder 324 and piston 309. The pressure differential created across wiper seals 327, causes movable cylinder 324 to be urged downward relative to stationary piston 309, as shown more fully in FIGS. 8 and 9.

As shown in FIGS. 8 and 9, the preferred hydraulic actuation device 499 of the present invention is moved by high pressure fluid to an open position, with movable cylinder 324 moved downward relative to stationary piston 309. As shown in FIG. 8, cylinder stop 350 and piston lock nut 320 are separated by distance D1. This distance of travel is an amount sufficient to move valve head 108*a* a selected distance away from valve seat 107.

FIG. 12 is fragmentary longitudinal section view of annulus safety valve 100, which depicts the interrelationship between hydraulic actuator 499 and equalizing valve assembly 521. As movable cylinder 324 is moved downward, to the right, relative to stationary piston 309, in response to high pressure fluid directed downward through passage 301 to piston fluid channel 501, control mandrel 115 is likewise moved downward (to the right) along with movable cylinder 324. As discussed above, control mandrel 115 extends circumferentially around inner conduit 102, and thus will move valve head 303 out of sealing engagement with valve seat 302, causing equalizing valve 521 to be moved a selected distance 305 to allow equalization of pressure across annular safety valve 100. As shown in FIG. 12, equalizing valve 521 is similar in construction to valve members discussed above, and includes spring 525 which biases valve head 303 against valve seat 302. Valve head 303 is integrally formed and coupled with valve stem 311, which is movable downward relative to stationary guide pieces 527, 529, 531.

FIG. 13 is a fragmentary, longitudinal section view of the preferred annular safety valve 100 of the present invention, which depicts the relationship between valve assembly 106, and equalization valve assembly 521.

As shown in FIG. 13, when equalization valve assembly 521 is in an open condition, valve assembly 106 remains in its normally-closed condition, with valve head 108 sealingly engaging valve seat 107. The fluid path 551 which supplies fluid to equalizing valve assembly 521 is a tiny fluid path, much smaller in cross-sectional area than the fluid passage which provides fluid to valve assembly 106. The fluid path 551 of FIG. 13 allows for minute quantities of extremely high pressure fluid to be passed through annular safety valve 100 to equalize the pressure differential across annular safety valve 100 before valve head 108 is brought out of sealing engagement with valve seat 107. This is a safety feature which prevents catastrophic failure which frequently occurs when valves are open at high pressure differentials.

In broad terms, the present invention, valve assembly 106, hydraulic actuator 499, and equalizing valve assembly 521 cooperate together to allow the passage of fluid through annular safety valve 100. The process begins when hydraulic actuator 499 is actuated, so that movable cylinder 324 is displaced relative to stationary piston 309, in response to high pressure fluid directed into annular safety valve 100 by a high pressure hose (or control line). Movement of movable cylinder 324 relative to stationary piston 309 causes equalizing valve assembly 521 to move between a normally-closed position and an open position, to equalize pressure across annulus safety valve 100 prior to movement of valve assembly 106 between a normally-closed position and an open position. Valve assembly 106 is the final component in annular safety valve 100 which moves between closed and open positions.

In the preferred embodiment of the present invention, a plurality of valve assemblies 106 may be provided circumferentially about inner conduit 102, all mechanically coupled together by central mandrel 115, which extends circumferentially about inner conduit 102. Each of the plurality of valve assemblies 106 may be calibrated to open at a different fluid pressure level which is provided by a high pressure hose or control line, by fixing the length and position of valve mandrel 111 relative to control mandrel 115. For example, one valve assembly 106 may be adapted to open upon movement of movable cylinder 324 relative to stationary piston 309 by a selected distance D1. A second valve assembly 106 may be adapted to open at another, different distance D2 of travel of movable cylinder 324 relative to stationary piston 309. A third and final valve assembly 106 may be provided to move between closed and open positions upon movement of movable cylinder 324 relative to stationary piston 309 by a predetermined longer distance D3. As high pressure fluid is supplied to hydraulic actuator 499, it will move first to distance D1, then to distance D2, and finally to distance D3. Thus, the plurality of valve assemblies 106 may be sequentially and successively actuated at predetermined pressure thresholds. Of course, equalizing valve assembly 521 will actuate prior to any of valve assemblies 106 to equalize the high pressure differential across annular safety valve 100. In other embodiments, multiple equalizing valve assemblies 521 may be provided.

Finally, the present invention need not communicate with high pressure hoses or control lines. Instead, the annular region between the tubing and casing may be pressurized with a wellbore pump, or surface pump, to obtain sufficient pressure levels to operate hydraulic actuator 499, equalizing valve assembly 521, and one or more valve assemblies 106.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

While the invention has been shown in only one of its forms, it is not thus limited but is susceptible to various changes and modifications without departing from the spirit thereof.

What is claimed and defined is to be secured by Letters Patent is:

1. A subterranean well annulus safety valve for control of fluid flow in an annulus defined between outer and inner tubular conduits concentrically disposed within the well, the conduits extending from an end of the safety valve to a point in the well, the annulus safety valve comprising:

a housing securable to the inner of the tubular conduits;

a fluid flow passageway defined through the housing and in fluid flow communication with the inner of the tubular conduits;

a plurality of valve passages circumferentially spaced about the housing in fluid flow communication at one end thereof with fluid in the annulus between the outer and inner tubular conduits within the well;

equalizing valve means including equalizing valve head and seat members disposed in at least one of the valve passages, the equalizing valve head and seat members being in normally closed position to prevent fluid in the annulus from flowing through said equalizing valve means, the equalizing valve head and seat members being movable relative to one another to permit fluid flow through the equalizing valve means; and at least one control valve means including control valve head and seat members disposed in at least one of the valve passages, the control valve head and seat members being in normally closed position to prevent fluid in the annulus from flowing through the control valve means, the control valve head and seat members being movable relative to one another to permit fluid flow through the control valve means.

2. The annulus safety valve according to claim 1 wherein an inner diameter of the inner tubular conduit is substantially equal to an inner diameter of the housing.

3. The annulus safety valve according to claim 1 further comprising:

an equalizing valve biasing member for biasing each of the at least one equalizing valve heads into normally closed position; and a control valve biasing member for biasing each of the at least one control valve heads into normally closed position.

4. The annulus safety valve according to claim 1, having a plurality of operating modes including:

a normally closed mode in which fluid is not permitted to flow from the annulus through the plurality of valve passages;

an equalizing mode in which a first volume of fluid is permitted to flow from the annulus through the valve passages having equalizing valve means disposed therein;

a flowing mode in which a second volume of fluid, of larger magnitude than the first volume, is permitted to flow from the annulus through the valve passages having control valve means disposed therein; and a bypass mode in which fluid is permitted to flow through the plurality of valve passages and into the annulus, in a flow direction opposite that of the equalizing mode and the flowing mode.

5. The annulus safety valve according to claim 1 further comprising at least one plug member, removably engaged in at least one of the valve passages for entirely obstructing fluid flow therethrough.

6. The annulus safety valve according to claim 1 further comprising at least one plug member, shearably engaged in at least one of the valve passages in the second housing, wherein the plug may be urged out of engagement with the valve passage by fluid pressure of sufficient amplitude.

7. The annulus safety valve according to claim 1 wherein an actuator is connected in fluid communication with a control conduit for receiving fluid flow for the selective actuation of the equalizing valve means and control valve means in response to fluid pressure of a preselected amplitude from the control conduit.

8. The annulus safety valve according to claim 1 wherein a control member is mechanically linked to the at least one equalizing valve means and the at least one control valve means to actuate and permit fluid flow through the equalizing valve means before actuating and permitting fluid flow through the control valve means, the control member actuable in response to fluid pressure of a selected amplitude from a control unit.

9. An annulus safety valve for use in a subterranean well, for control of fluid flow in an annulus defined between an outer tubular conduit and an inner tubular conduit concentrically disposed within the well, the conduits extending from a first end of the safety valve to a point in said well, the annulus safety valve comprising:

a cylindrical central housing securable to the inner tubular conduit;

a fluid flow passage defined through the central housing, in fluid flow communication with the interior of the inner tubular conduit;

a second housing circumferentially extending around the exterior of, and carried by, the central housing, the second housing having a plurality of valve passages therein in fluid flow communication at one end thereof with fluid in the annulus between the inner and outer conduits;

at least one equalizing valve including equalizing valve head and seat members, disposed in at least one valve passage in the second housing, the at least one equalizing head and seat members being in normally closed position and selectively actuable to move relative to one another to permit fluid flow through the at least one equalizing valve;

at least one control valve including control valve head and seat members, disposed in at least one valve passage in the second housing, the at least one control valve head and seat members being in normally closed position and selectively actuable to move relative to one another to permit fluid flow through the at least one control valve;

a control member mechanically linked to the at least one equalizing valve and the at least one control valve for sequentially actuating the at least one equalizing valve and at least one control valve; and an actuator mechanically linked to the control member, for selectively actuating the control member, thereby sequentially actuating the at least one equalizing valve and at least one control valve.

10. The annulus safety valve according to claim 2 wherein an inner diameter of the inner tubular conduit is substantially equal to an inner diameter of the central housing.

11. The annulus safety valve according to claim 2 further comprising:

an equalizing valve biasing member for biasing each of the at least one equalizing valve heads into normally closed position; and a control valve biasing member for biasing each of the at least one control valve heads into normally closed position;

a control biasing member for biasing the control member into an unactuated position while the at least one control valve and at least one equalizing valve are in normally closed position.

12. The annulus safety valve according to claim 2, having a plurality of operating modes including:

a normally closed mode in which fluid is not permitted to flow from the annulus through the plurality of valve passages in the second housing;

an equalizing mode in which a first volume of fluid is permitted to flow from the annulus through the valve passages in the second housing having equalizing valve members disposed therein;

a flowing mode in which a second volume of fluid, of larger magnitude than the first volume, is permitted to flow from the annulus through the valve passages in the second housing having control valve members disposed therein; and a bypass mode in which fluid is permitted to flow through the plurality of valve passages in the second housing and into the annulus, in a flow direction opposite that of the equalizing mode and the flowing mode.

13. The annulus safety valve according to claim 2 further comprising at least one plug member, removably engaged in at least one of the valve passages in the second housing for entirely obstructing fluid flow therethrough.

14. The annulus safety valve according to claim 2 further comprising at least one plug member, shearably engaged in at least one of the valve passages in the second housing, wherein the plug may be urged out of engagement with the valve passage by fluid pressure of sufficient amplitude.

15. The annulus safety valve according to claim 2 wherein the actuator is connected in fluid communication with a control conduit for receiving fluid flow for the selective actuation of the annulus safety valve in response to fluid pressure of a preselected amplitude from the control conduit.

16. The annulus safety valve according to claim 2 wherein the control member is mechanically linked to the at least one equalizing valve and the at least one control valve to actuate and permit fluid flow through the equalizing valve before actuating and permitting fluid flow through the control valve.

17. An annulus safety valve for use in a subterranean well, for control of fluid flow in an annulus defined between an outer tubular conduit and an inner tubular conduit concentrically disposed within the well, the conduits extending from a first end of the safety valve to a point in said well, the annulus safety valve comprising:

a cylindrical central housing securable to the inner tubular conduit;

a fluid flow passage defined through the central housing in fluid flow communication with the interior of the inner tubular conduit;

a second housing circumferentially extending around the exterior of, and carried by, the central housing, the second housing having a plurality of valve passages therein in fluid flow communication at one end thereof with fluid in the annulus between the inner and outer conduits;

at least one equalizing valve including equalizing valve head and seat members, disposed in at least one valve passage in the second housing, the at least one equalizing valve head and seat members being in normally closed position and selectively actuable to move relative to one another to permit fluid flow through the at least one equalizing valve;

at least one control valve including control valve head and seat members, disposed in at least one valve passage in the second housing, the head and seat members being in normally closed position and selectively actuable to move relative to one another to permit fluid flow through the at least one control valve;

a control member mechanically linked to the at least one equalizing valve and the at least one control valve for sequentially actuating the at least one equalizing valve and at least one control valve;

an actuator, mechanically linked to the control member and in fluid flow communication with a control conduit, for selectively actuating the control member and thereby actuating the at least one equalizing valve and at least one control valve in response to an increase in fluid pressure amplitude from the control conduit;

a control valve biasing member for biasing each of the at least one control valve heads into a normally closed position;

an equalizing valve biasing member for biasing each of the at least one equalizing valve heads into a normally closed position;

a control biasing member for biasing the control member into an unactuated position while the at least one control valve and the at least one equalizing valve are in normally closed position.

wherein the annulus safety valve is operable in a plurality of operating modes including:

a normally closed mode in which fluid is not permitted to flow from the annulus through the plurality of valve passages in the second housing;

an equalizing mode in which a first volume of fluid is permitted to flow from the annulus through the valve passages in the second housing having equalizing valve members disposed therein;

a flowing mode in which a second volume of fluid, of larger magnitude than the first volume, is permitted to flow from the annulus through the valve passages in the second housing having control valve members disposed therein; and a bypass mode in which fluid is permitted to flow through the plurality of valve passages in the second housing and into the annulus in a flow direction opposite that of the equalizing mode and the flowing mode.

18. The annulus safety valve according to claim 17 wherein an inner diameter of the inner tubular conduit is substantially equal to an inner diameter of the central housing;

19. The annulus safety valve according to claim 17 further comprising at least one plug member, removably engaged in at least one of the valve passages in the second housing for entirely obstructing fluid flow therethrough.

20. An annulus safety valve for use in a subterranean well, the subterranean well having an outer tubular conduit and an inner tubular conduit concentrically disposed therein, the conduits extending from a first end of the safety valve, the inner tubular conduit extending through a wellbore sealing member, to a point in the subterranean well, the inner tubular conduit, outer tubular conduit, and wellbore sealing member defining an annulus containing a fluid in a pressurized condition that creates a pressure differential across the wellbore sealing member, the annulus safety valve comprising:

a cylindrical central housing securable to the inner tubular conduit;

a fluid flow passage defined through the central housing in fluid flow communication with the interior of the inner tubular conduit;

a second housing circumferentially extending around the exterior of, and carried by, the central housing, the second housing having a plurality of valve passages therein in fluid flow communication at one end thereof with the pressurized fluid in the annulus between the inner and outer conduits;

at least one equalizing valve, including equalizing valve head and seat members, disposed in at least one valve passage in the second housing, the equalizing valve head and seat members being in normally closed position and selectively actuable to move relative to one another to permit fluid flow through the at least one equalizing valve, thereby equalizing the pressure differential across the wellbore sealing means;

at least one control valve including control valve head and seat members, disposed in at least one valve passage in the second housing, the control valve head and seat members being in normally closed position and selectively actuable to move relative to one another to permit fluid flow through the at least one control valve;

a control member, mechanically linked to the at least one equalizing valve and at least one control valve for sequentially actuating the at least one equalizing valve and at least one control valve;

an actuator, mechanically linked to the control member and in fluid flow communication with a control conduit for selectively actuating the control member and thereby sequentially actuating the at least one equalizing valve and at least one control valve in response to fluid pressure of a preselected amplitude from the control conduit;

a control valve biasing member for biasing each of the at least one control valve heads into a normally closed position;

an equalizing valve biasing member for biasing each of the at least one equalizing valve heads into a normally closed position;

a control biasing member for biasing the control member into an unactuated position while the at least one control valve and the at least one equalizing valve are in normally closed position.

wherein the annulus safety valve is operable in a plurality of operating modes including:

a normally closed mode in which fluid is not permitted to flow from the annulus through the plurality of valve passages in the second housing;

an equalizing mode in which a first volume of fluid is permitted to flow from the annulus through the valve passages in the second housing having equalizing valve members disposed therein in response to control fluid pressure of a first preselected amplitude applied to the actuator from the control conduit, thereby reducing the pressure differential across the wellbore sealing element;

a flowing mode in which a second volume of fluid, of larger magnitude than the first volume, is permitted to flow from the annulus through the valve passages in the second housing having control valve members disposed therein in response to control fluid pressure of a second preselected amplitude, greater in magnitude than the first preselected amplitude, applied to the actuator from the control conduit; and a bypass mode in which fluid is permitted to flow through the plurality of valve passages in the second housing and into the annulus in a direction opposite that of the equalizing mode and the flowing mode.

21. The annulus safety valve according to claim 20 wherein:

at least one wellbore tool is disposed in a flow path, at least partially defined by the outer tubular conduit, that may be damaged by exposure to an uncontrolled fluid flow from the annulus; and the sequential operation of the annulus safety valve in the plurality of operating modes prevents the uncontrolled fluid flow from the annulus.

22. The annulus safety valve according to claim 20 wherein an inner diameter of the inner tubular conduit is substantially equal to an inner diameter of the central housing;

23. The annulus safety valve according to claim 20 further comprising at least one plug member, removably engaged in at least one of the valve passages in the second housing for entirely obstructing fluid flow therethrough.

24. A method of controlling fluid flow in an annulus defined between an outer tubular conduit and an inner tubular conduit, concentrically disposed within a subterranean well, the conduits extending from a first end of an annular safety valve to a point in the well, comprising the steps of:

assembling at the top of the well, onto the inner tubular conduit, an annulus safety valve, including:

a housing securable to the inner tubular conduit;

a fluid flow passage defined through the housing, in fluid flow communication with the of the inner tubular conduit;

a plurality of valve passages circumferentially spaced about the housing in fluid flow communication at one thereof with fluid in the annulus between the inner and outer conduits;

at least one equalizing valve including equalizing valve head and seat members, disposed in at least one valve passage, the head and seat members being in normally closed position and selectively actuable to move relative to one another to permit fluid flow through the at least one equalizing valve;

at least one control valve including control valve head and seat members, disposed in at least one valve passage, the control valve head and seat members being in normally closed position and selectively actuable to move relative to one another to permit fluid flow through the at least one control valve;

running the annulus safety valve into position within the well;

actuating the equalizing valve head and seat members from the normally closed position to permit fluid flow therethrough; and further actuating the control valve head and seat members from the normally closed position to permit fluid flow therethrough.

25. The method according to claim 17 in which the step of running the annulus safety valve into position further comprises:

running the annulus safety valve into said well tandemly with a wellbore sealing member positionable below the annulus safety valve and including a flow passage therethrough extending to and in fluid communication with the interior of the outer tubular conduit, and further including anchoring and sealing members movable from a first running position to a second expanded position, wherein the wellbore sealing member is positioned in the well in an anchored and sealing engagement with a casing conduit disposed within the well, and, when in the anchored and sealing position, a passage therethrough is in fluid communication with the interior of the casing below the wellbore sealing member.

26. The method according to claim 24 further comprising the steps of:

running the inner and outer tubular conduits into the well; and setting a wellbore sealing member from a running position to an anchored and sealing position.

27. The method of claim 24 further comprising the step of introducing fluid from above the annulus safety valve into the annulus by pressurizing fluid above the annulus safety valve to a selected magnitude, wherein the fluid flows through the flow passages having equalizing valves and control valves disposed therein and into the annulus.

28. A subterranean well annulus safety valve for control of fluid flow in an annulus defined between outer and inner tubular conduits disposed within the well, the conduits extending from an end of the annulus safety valve to a point in the well, the annulus safety valve comprising:

a housing securable to the inner of the tubular conduits;

a fluid flow passageway defined through the housing and in fluid flow communication with the inner of the tubular conduits;

a plurality of valve passages circumferentially spaced about the housing and in fluid flow communication at one end thereof with fluid in the annulus between the outer and inner conduits;

equalizing valve means, including head and seat members, disposed in at least one of the valve passages, the head and seat members in normally closed position to prevent fluid flow from the annulus through the equalizing valve means, the head and seat members movable relative to one another to permit fluid flow through the equalizing valve means; and at least one control valve means disposed in at least one of the valve passages, the control valve means being in normally closed position to prevent fluid flow from the annulus through the control valve means, the at least one control valve means actuable to permit fluid flow therethrough in a volume greater than that through the equalizing valve means.

29. The annulus safety valve according the claim 28 wherein an inner diameter of the inner conduit is substantially equal to that of an inner diameter of the housing.

30. The annulus safety valve according to claim 28, having a plurality of operating modes including:

a normally closed mode in which fluid is not permitted to flow from the annulus through the plurality of valve passages;

an equalizing mode in which a first volume of fluid is permitted to flow from the annulus through the valve passages having equalizing valve means disposed therein;

a flowing mode in which a second volume of fluid, of larger magnitude than the first volume, is permitted to flow from the annulus through the valve passages having control valve means disposed therein; and a bypass mode in which fluid is permitted to flow through the plurality of valve passages and into the annulus, in a flow direction opposite that of the equalizing mode and the flowing mode.

31. The annulus safety valve according to claim 28 wherein an actuator is connected in fluid communication with a control conduit for receiving fluid flow for the selective actuation of the equalizing valve means and control valve means in response to fluid pressure of a preselected amplitude from the control conduit.

32. The annulus safety valve according to claim 28 wherein a control member is mechanically linked to the at least one equalizing valve means and the at least one control valve means to actuate and permit fluid flow through the equalizing valve means before actuating and permitting fluid flow through the control valve means, the control member actuable in response to fluid pressure of a selected amplitude from a control conduit.

* * * * *